US010515774B2

(12) United States Patent
Sunohara et al.

(10) Patent No.: US 10,515,774 B2
(45) Date of Patent: Dec. 24, 2019

(54) ELECTROMAGNETIC RELAY

(71) Applicant: FUJITSU COMPONENT LIMITED, Tokyo (JP)

(72) Inventors: Takaki Sunohara, Tokyo (JP); Nobuyoshi Hiraiwa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/055,989

(22) Filed: Feb. 29, 2016

(65) Prior Publication Data

US 2017/0092450 A1 Mar. 30, 2017

(30) Foreign Application Priority Data

Sep. 28, 2015 (JP) ..... 2015-190166

(51) Int. Cl.
*H01H 51/22* (2006.01)
*H01H 50/02* (2006.01)
(Continued)

(52) U.S. Cl.
CPC ..... *H01H 50/02* (2013.01); *H01H 50/24* (2013.01); *H01H 50/36* (2013.01); *H01H 50/44* (2013.01)

(58) Field of Classification Search
CPC ..... H01H 9/443
(Continued)

(56) References Cited

U.S. PATENT DOCUMENTS 6,781,490 B2 * 8/2004 Funayama ..... H01H 50/026 335/78
6,873,232 B2 * 3/2005 Chida ..... H01H 50/002 335/78
(Continued)

FOREIGN PATENT DOCUMENTS

EP 1 923 898 5/2008
EP 2 688 083 1/2014
(Continued)

OTHER PUBLICATIONS

Japan Platform for Patent Information, Publication No. 2011-81961 published Apr. 21, 2011.
(Continued)

*Primary Examiner* — Alexander Talpalatski
(74) *Attorney, Agent, or Firm* — Staas & Halsey LLP

(57) ABSTRACT

An electromagnetic relay includes: a first member integrally including a first horizontal portion to which an armature is fixed, a vertical portion to which a yoke is fixed, a hinge spring connected between the vertical portion and the first horizontal portion, a spring arm including a pair of movable contacts, and a pair of first terminals extended downward from the vertical portion; a second member integrally including a front plate portion extended in front of an electromagnet in a vertical direction, a second horizontal portion including a pair of fixed contacts opposed to the movable contacts, and a pair of second terminals extended downward from the front plate portion; a pair of permanent magnets that sandwich the movable contacts and the fixed contacts in a right-to-left direction and that is not opposed to the electromagnet; and a cover including accommodating portions accommodating the permanent magnets.

7 Claims, 7 Drawing Sheets

(51) Int. Cl.
*H01H 50/24* (2006.01)
*H01H 50/36* (2006.01)
*H01H 50/44* (2006.01)

(58) Field of Classification Search
USPC ..... 335/78, 201
See application file for complete search history.

(56) References Cited

U.S. PATENT DOCUMENTS 7,477,119 B2 * 1/2009 Wu ..... H01H 50/043 335/128
7,782,162 B2 * 8/2010 Nishida ..... H01H 50/56 335/201
8,305,166 B2 * 11/2012 Kojima ..... H01H 50/043 335/78
8,558,647 B2 * 10/2013 Shinkai ..... H01H 11/00 335/78
8,659,372 B2 * 2/2014 Morimura ..... H01H 50/02 335/201
8,963,663 B2 * 2/2015 Yano ..... H01H 1/66 335/151
9,007,155 B2 * 4/2015 Saito ..... H01H 51/04 335/42
9,082,575 B2 * 7/2015 Yamashita ..... H01H 9/443
2002/0161357 A1 10/2002 Anderson et al.
2009/0134962 A1 5/2009 Nishida
2011/0181381 A1 7/2011 Sasaki et al.
2013/0271244 A1 10/2013 Sasaki et al.
2014/0022035 A1 1/2014 Yamashita et al.
2014/0028418 A1 1/2014 Yamashita et al.
2014/0062626 A1 * 3/2014 Saito ..... H01H 51/04 335/185
2014/0159837 A1 * 6/2014 Hiraiwa ..... H01H 9/443 335/201
2014/0203897 A1 7/2014 Sasaki et al.
2015/0187526 A1 7/2015 Saito et al.

FOREIGN PATENT DOCUMENTS

JP 52-039161 3/1977
JP 58-150240 9/1983
JP 10-326553 12/1998
JP 2000-299045 10/2000
JP 2007-073308 3/2007
JP 2011-81961 4/2011
JP 2011-154818 8/2011
JP 3173878 2/2012
JP 2012-190764 10/2012
JP 2014-049315 3/2014

OTHER PUBLICATIONS

Japan Platform for Patent Information, Publication No. 2011-154818 published Aug. 11, 2011.
Japan Platform for Patent Information, Publication No. 2000-299045 published Oct. 24, 2000.
Japan Platform for Patent Information, Publication No. 10-326553 published Dec. 8, 1998.
Extended European Search Report dated Jan. 3, 2017 in corresponding European Patent Application No. 16162824.3, 8 pages.
Notification of Reasons for Refusal issued Sep. 3, 2019 in corresponding Japanese Patent Application No. 2015-190166, 4 pages.

* cited by examiner

ELECTROMAGNETIC RELAY

CROSS-REFERENCE TO RELATED APPLICATION

This application is based upon and claims the benefit of priority of the prior Japanese Patent Application No. 2015-190166 filed on Sep. 28, 2015, the entire contents of which are incorporated herein by reference.

FIELD

A certain aspect of the embodiments is related to an electromagnetic relay.

BACKGROUND

There has been conventionally known an electromagnetic relay (hereinafter, referred to as a relay) used for the switching control of an electric circuit of an on-vehicle electric power steering, i.e., an electric circuit through which relatively large inrush current (e.g., 60 A) flows at the moment when a contact is closed as disclosed in, for example, Japanese Patent Application Publication No. 2011-81961. There has been also known a relay capable of enhancing an arc-extinguishing effect as disclosed in, for example, Japanese Patent Application Publication No. 2011-154818.

There has been also known hybrid vehicles that employ a mild hybrid system and in which a DC48V battery is installed. The mild hybrid system uses an engine as a main power source, and uses a motor to assist the engine when the vehicle is stopped or started.

SUMMARY

According to an aspect of the present invention, there is provided an electromagnetic relay including: an electromagnet; a first member configured to integrally include a first horizontal portion to which an armature to be attracted to the electromagnet is fixed, a vertical portion to which a yoke connected to the electromagnet and the armature is fixed, a hinge spring connected between the vertical portion and the first horizontal portion, a spring arm that is extended frontward from the first horizontal portion and includes a pair of movable contacts, and a pair of first terminals that is extended downward from the vertical portion; a second member configured to integrally include a front plate portion that is extended in front of the electromagnet in a vertical direction, a second horizontal portion that is formed by bending a top portion of the front plate portion rearward, is extended from the top portion of the front plate portion, and includes a pair of fixed contacts opposed to the pair of movable contacts, and a pair of second terminals extended downward from the front plate portion; a pair of permanent magnets configured to be arranged at positions at which the pair of permanent magnets sandwiches the pair of movable contacts and the pair of fixed contacts and is not opposed to the electromagnet in a right-to-left direction; and a cover configured to include an accommodating portion that accommodates the pair of permanent magnets and to cover the electromagnet, the first member, and the second member.

The objects and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Relays used for low voltage batteries, e.g., DC12V batteries can be configured to be small in size and light in weight. However, when the relay is connected to a battery with a voltage exceeding an assumed voltage, for example, is connected to a DC48V battery, it is impossible to interrupt an arc generated in the relay. Thus, the relay cannot be used for a DC48V battery (i.e., a high voltage battery).

The relay disclosed in Japanese Patent Application Publication No. 2011-154818 has a structure designed to drive a movable-side spring terminal via a card. Accordingly, the heat of the arc may distort the shape of the card, and the relay may malfunction.

Relays used in circuits mounted on electric vehicles or large-scale direct current apparatuses have high arc-interrupting performance, but poor continuous current-carrying performance. In addition, as the current-carrying capacity of the relay increases, the size of the relay increases.

An embodiment of the present invention will be described hereinafter with reference to the drawings.

Figure 1:
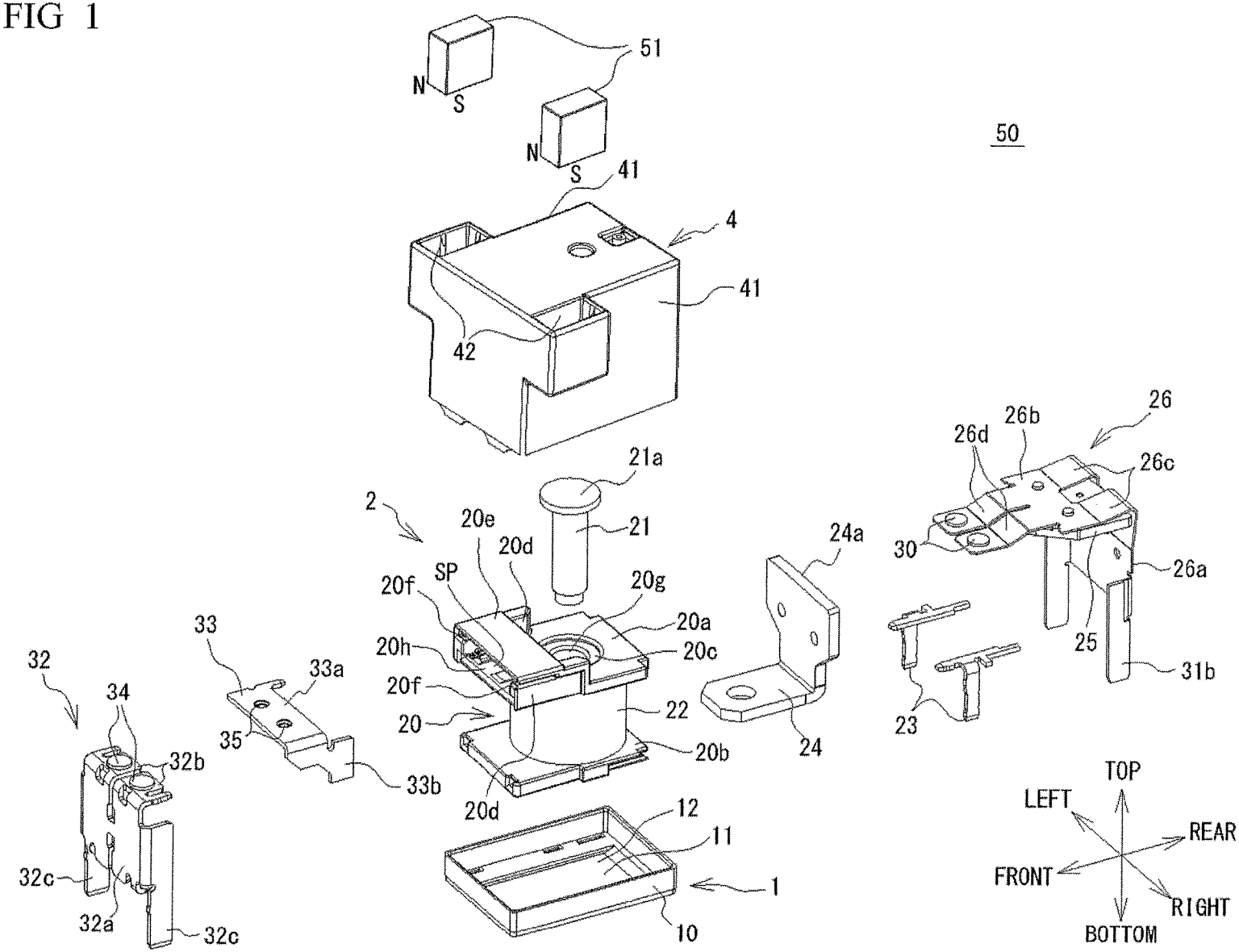
FIG. 1 is an exploded perspective view of an electromagnetic relay in accordance with an embodiment.
Figure 2:
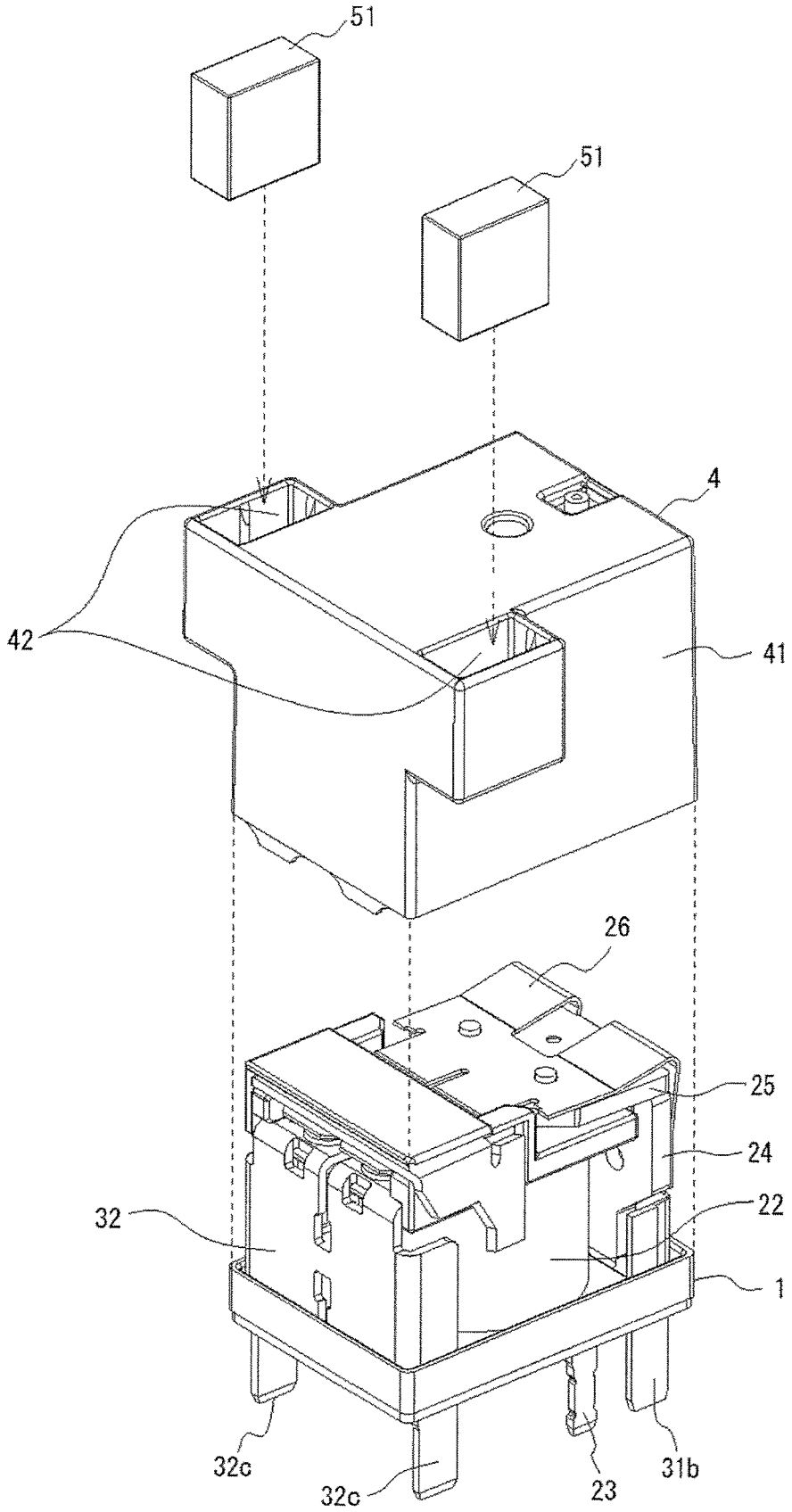
FIG. 2 is a perspective view illustrating an assembly structure of the electromagnetic relay.
Figure 3:
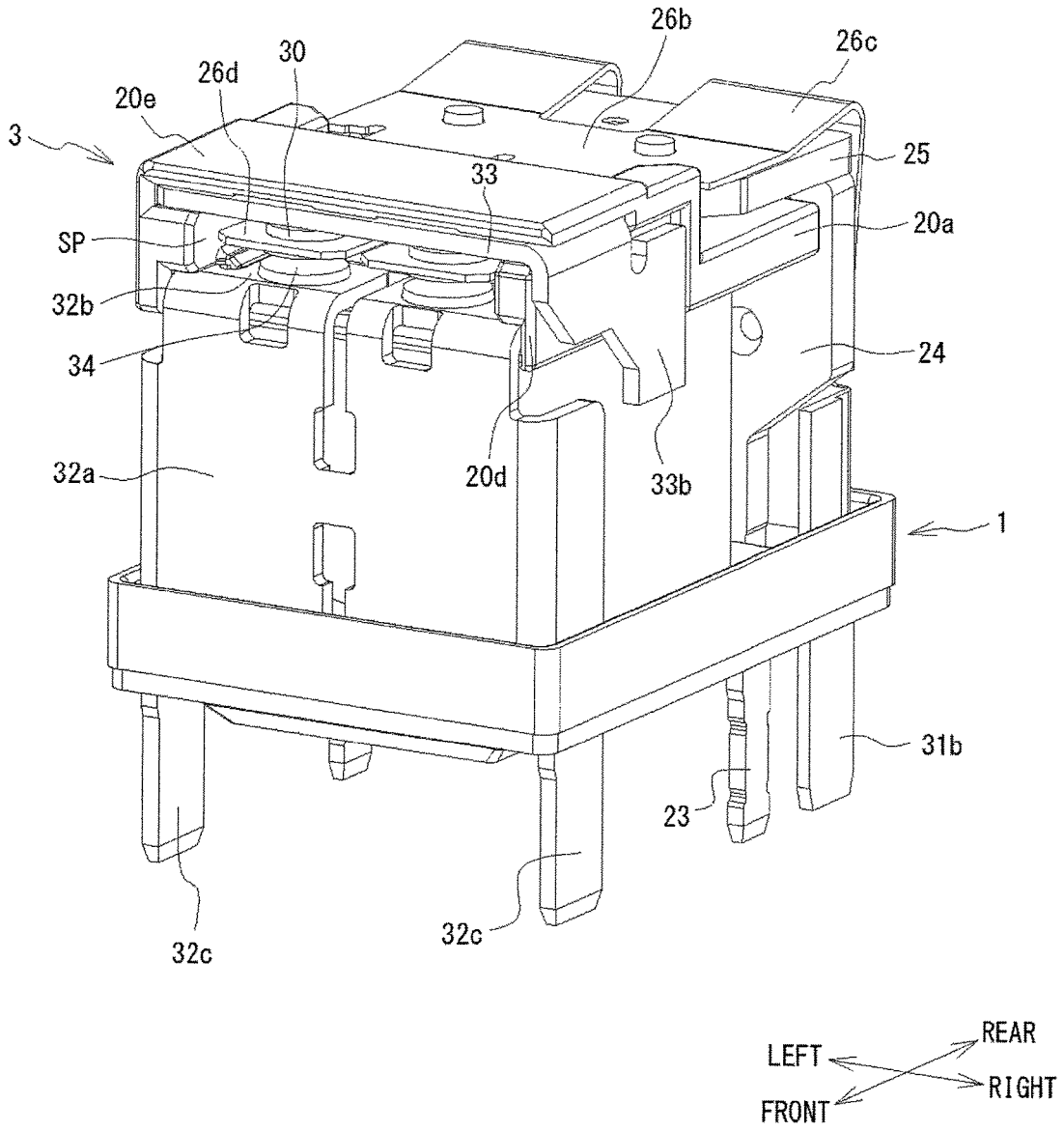
FIG. 3 is a perspective view illustrating the assembly structure of the electromagnetic relay with a cover removed.
Figure 4:
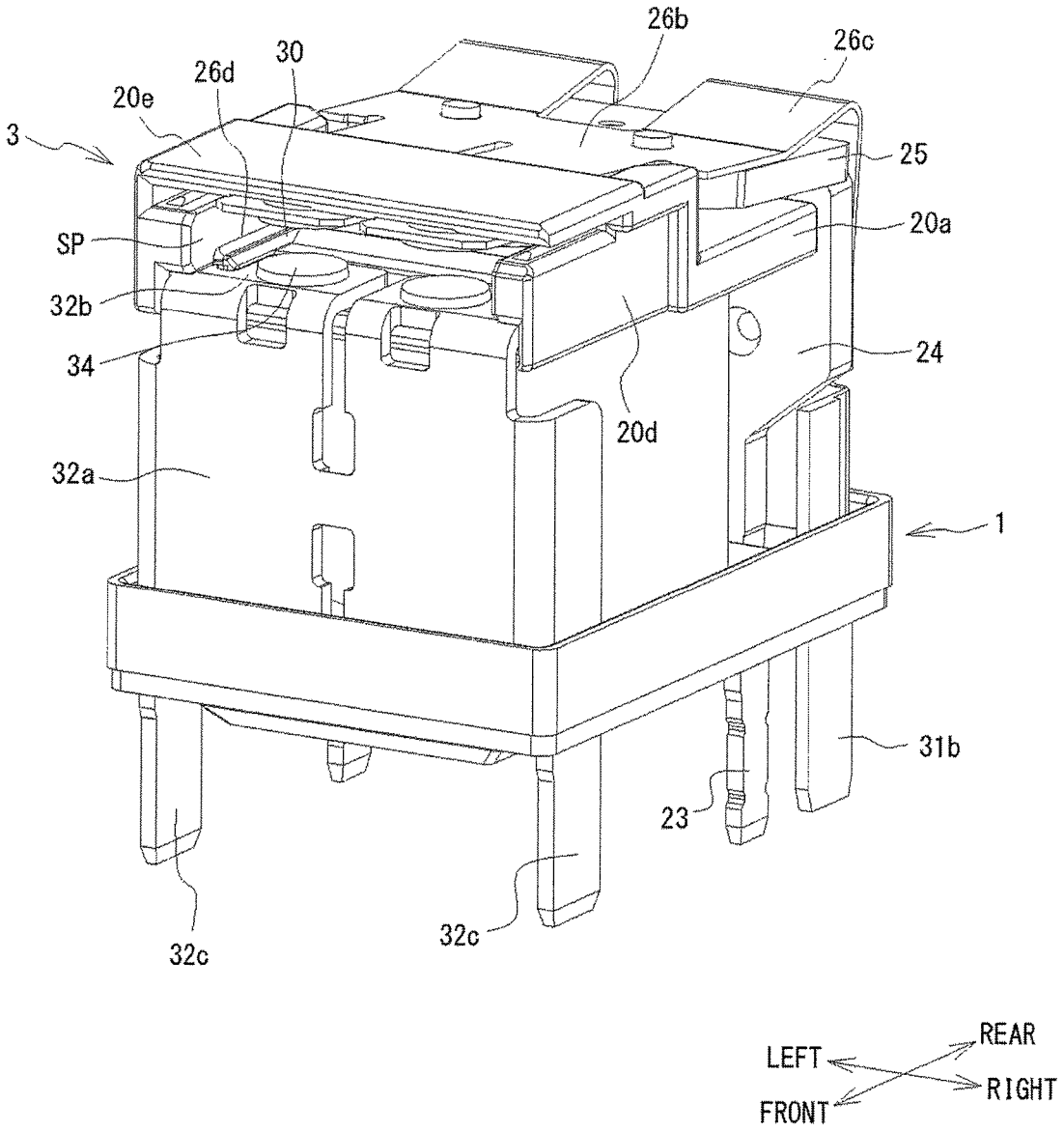
FIG. 4 is a perspective view illustrating the assembly structure of the electromagnetic relay with the cover removed.
Figure 5:
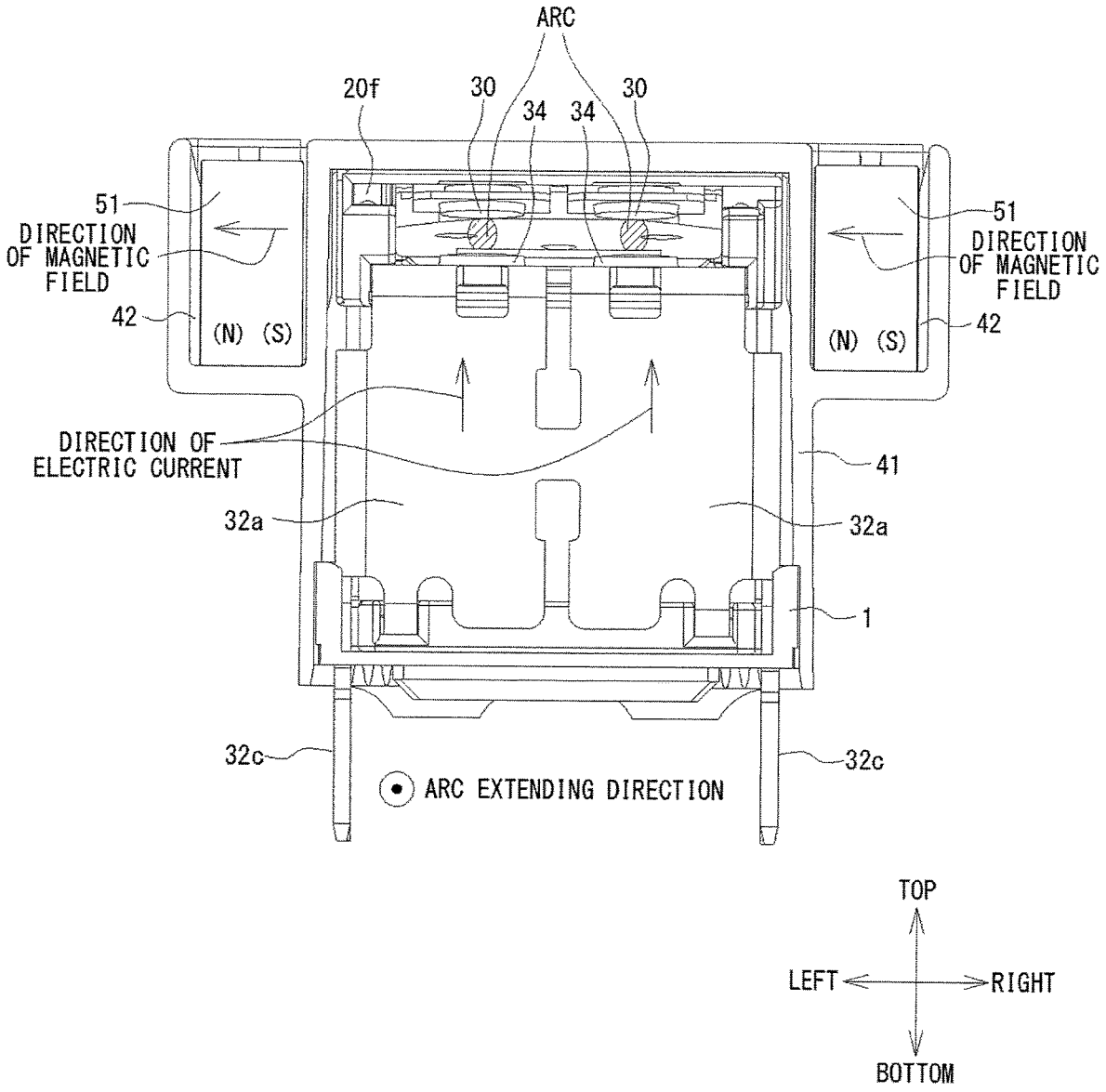
FIG. 5 is a cross-sectional view illustrating the assembly structure of the electromagnetic relay (the cross-section in the front direction)
Figure 6:
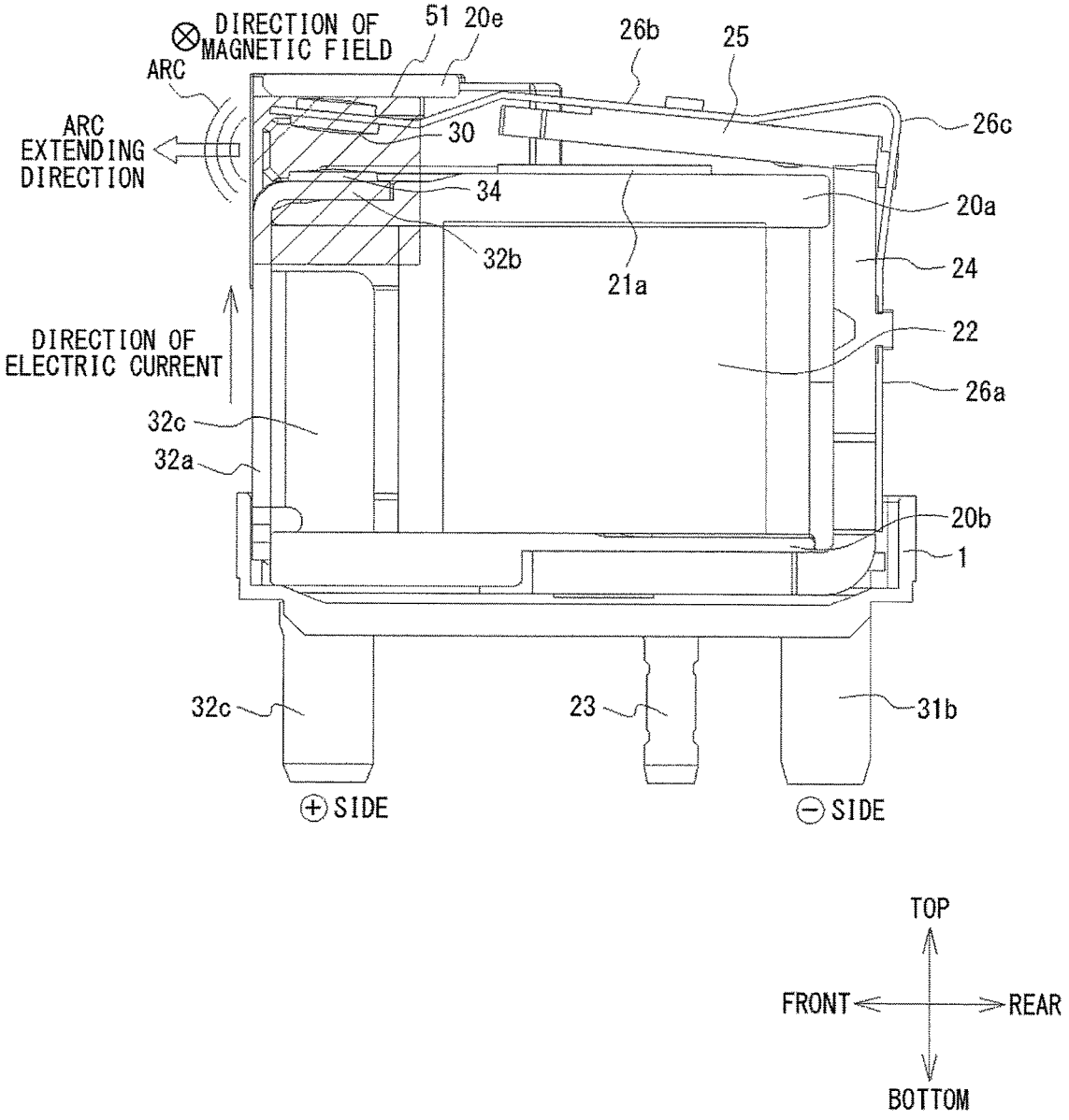
FIG. 6 is a cross-sectional view illustrating the assembly structure of the electromagnetic relay with the cover removed (the cross-section in the side direction)
Figure 7:
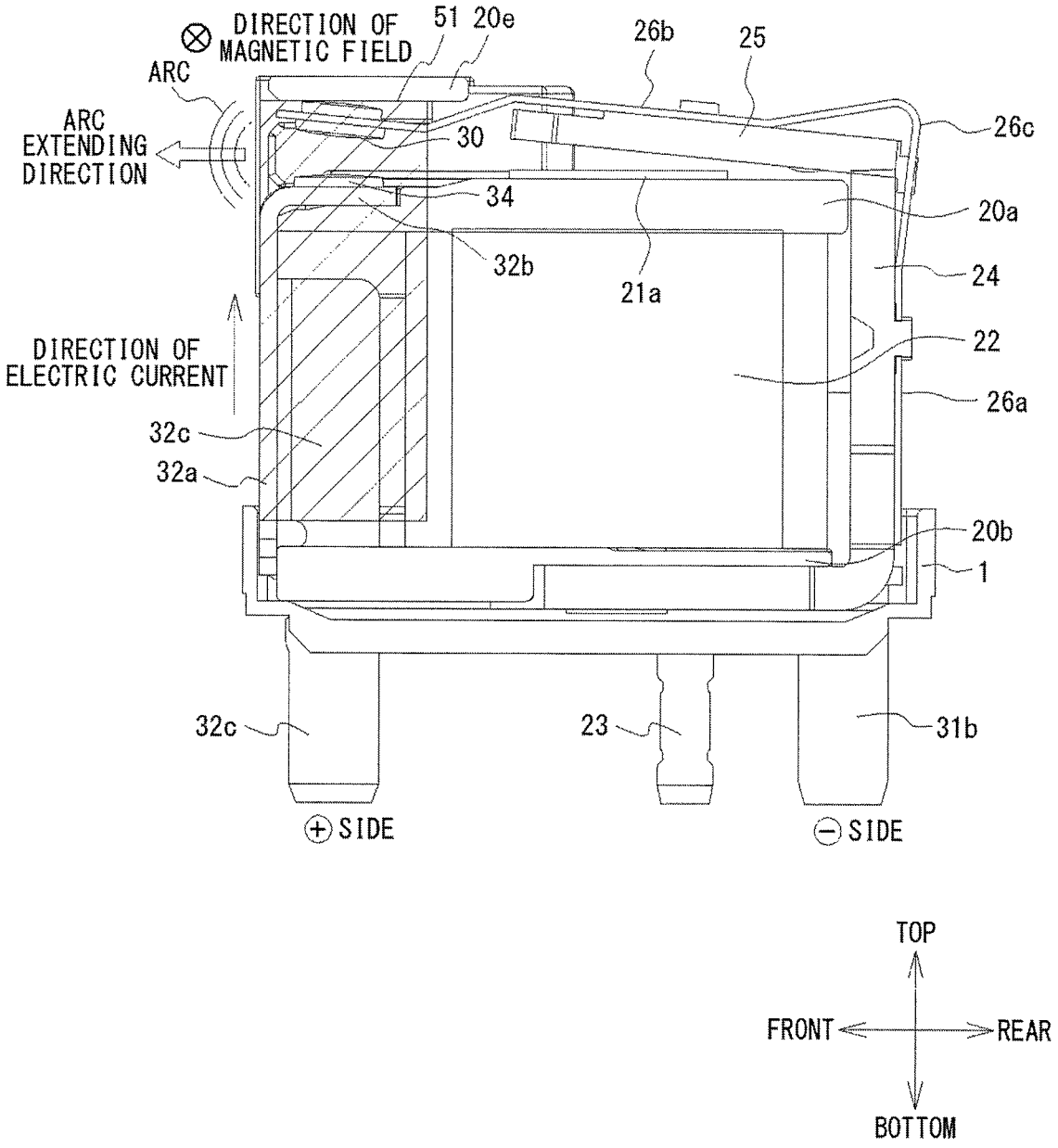
FIG. 7 is a cross-sectional view illustrating the assembly structure of the electromagnetic relay with the cover removed (the cross-section in the side direction).

FIG. 1 is an exploded perspective view of an electromagnetic relay in accordance with the embodiment, and FIG. 2 is a perspective view illustrating an assembly structure of the electromagnetic relay. FIG. 3 and FIG. 4 are perspective views illustrating the assembly structure of the electromagnetic relay with a cover removed. FIG. 5 is a cross-sectional view illustrating the assembly structure of the electromagnetic relay (the cross-section in the front direction). FIG. 6 and FIG. 7 are cross-sectional views illustrating the assembly structure of the electromagnetic relay with the cover removed (the cross-section in the side direction). For convenience sake, front-to-rear and right-to-left directions and a top-to-bottom direction are defined as illustrated in the drawings hereinafter, and the configuration of each component will be described in accordance with the definition. The electromagnetic relay of the present embodiment is used in a hybrid vehicle that employs the mild hybrid system and in which, for example, a DC48V battery is installed. More specifically, the electromagnetic relay of the present embodiment is used for the switching control of the control circuit of the DC48V battery, but may be used in many applications.

An electromagnetic relay 50 of the present embodiment is a sealed hinge-type relay, and includes a base block 1, an electromagnet 2 embedded in the base block 1, a contact portion 3 that opens and closes in response to the operation of the electromagnet 2, and a cover 4 that covers the electromagnet 2 and the contact portion 3. To illustrate the inner structure, FIG. 3 and FIG. 4 do not illustrate the cover 4. The contact portion 3 of FIG. 3 is configured as a so-called make contact, is opened at normal times, and is closed during the operation. The contact portion 3 is structured by a pair of movable contacts 30 and a pair of fixed contacts 34 described later. One of the movable contacts 30 and one of the fixed contacts 34 form a first contact pair, and the other of the movable contacts 30 and the other of the fixed contacts 34 form a second contact pair.

The base block 1 illustrated in FIG. 1 is made of an electrically-insulating resin molded article, and includes an approximately rectangular frame portion 10 and a bottom portion 11 that closes the bottom surface of the frame portion 10. In the base block 1, formed is a recess portion 12 that is defined by the frame portion 10 and the bottom portion 11 and opens upward. The recess portion 12 fixedly supports the electromagnet 2 and the contact portion 3. The cover 4 is adhesively fixed to the frame portion 10 of the base block 1.

The electromagnet 2 includes a hollow body 20*g* extended in the top-to-bottom direction, a spool 20 including an upper flange 20*a* located at the top of the spool 20 and a lower flange 20*b* located at the bottom of the spool 20, an iron core 21 accommodated in the hollow body 20*g* of the spool 20, and a coil 22 provided on the outer peripheral surface of the spool 20. The lower flange 20*b* of the spool 20 is fixedly supported by the recess portion 12 of the base block 1.

A stepped portion 20*c* is formed in the central part of the upper flange 20*a* of the spool 20. At the front side of the stepped portion 20*c*, located is a width narrowed portion 20*h* in which the width of the upper flange 20*a* in the right-to-left direction is narrowed. A pair of right and left side walls 20*d* are raised upward from the width narrowed portion 20*h*. The top end portion of the right side wall 20*d* is bent outward in the right direction. The right and left side surfaces of the top end portions of the side walls 20*d* and the right and left side surfaces of the upper flange 20*a* posterior to the side wall 20*d* are located on the same planes extending in the top-to-bottom direction in the drawing, respectively. Above the front end portion of the upper flange 20*a*, an upper wall 20*e* parallel to the upper flange 20*a* is provided between the right and left side walls 20*d*. The upper flange 20*a*, the right and left side walls 20*d*, and the upper wall 20*e* form an approximately box-shaped space SP of which the front and rear faces open. In the top end portions of the right and left side walls 20*d*, slits 20*f* are formed from the front end face to the rear to be parallel to the upper wall 20*e*. The left slit 20*f* leaves the wall surface of the left side wall 20*d* at the left end, while the right slit 20*f* penetrates through the wall surface of the right side wall 20*d* in the right-to-left direction. The slits 20*f* are used to mount a backstop 33 described later. The spool 20 is configured as an electrically-insulating resin molded article, and all the portions (20*a* through 20*h*) are integrally formed.

The iron core 21 is a columnar member formed from, for example, magnetic steel, and a top end face 21*a* of the iron core 21 is exposed to the outside from the upper flange 20*a* of the spool 20 while the iron core 21 is accommodated in the spool. The part of the iron core 21 excluding the top end face 21*a* is fixedly supported to the inside of the hollow body 20*g*. The winding wire of the coil 22 is wound around the outer peripheral surface of the hollow body 20*g* between the upper flange 20*a* and the lower flange 20*b* of the spool 20, and each of both ends of the coil 22 is connected to the corresponding one of a pair of right and left coil terminals 23 fixed to the base block 1. A yoke 24 is fixedly connected to the bottom end portion of the iron core 21 by, for example, swaging.

The yoke 24 is a plate-like member formed by die-cutting and bending, for example, a magnetic steel sheet into an L-shape in cross section. In a state where the electromagnetic relay 50 is assembled, the yoke 24 extends below the lower flange 20*b* of the spool 20 in the front-to-rear direction, and extends behind the hollow body 20*g* of the spool 20 in the top-to-bottom direction. A top 24*a* of the yoke 24 is located at approximately the same height as the top end face 21*a* of the iron core 21, and the top 24*a* supports an armature 25.

The armature 25 is a flat plate-like member formed by die-cutting, for example, a magnetic steel sheet, and is arranged approximately vertically above the upper flange 20*a* in the assembled state of the electromagnetic relay 50 as illustrated in FIG. 3. The rear end portion of the armature 25 contacts the top 24*a* of the yoke 24 and is swingably supported, and the front bottom face of the armature 25 is arranged to be opposed to the top end face 21*a* of the iron core 21. This configuration allows a magnetic circuit to be formed among the iron core 21, the yoke 24, and the armature 25 when the electromagnet 2 operates.

The armature 25 is mounted to a movable spring member 26 (a first member), and is connected resiliently relatively-movably to the yoke 24 via the movable spring member 26. The movable spring member 26 is a conductive plate spring member formed by die-cutting and bending, for example, a thin sheet of phosphor bronze for spring into an approximately L-shape. As illustrated in FIG. 1, the movable spring member 26 integrally includes a vertical portion 26*a* fixed on the rear face of the yoke 24 by, for example, swaging, a horizontal portion 26*b* (a first horizontal portion) fixed on the top face of the armature 25 by, for example, swaging, a pair of right and left hinge springs 26*c* that is formed by bending, and connects the vertical portion 26*a* to the horizontal portion 26*b*, and a pair of right and left spring arms 26*d* that is branched from the horizontal portion 26*b* in the right-to-left direction and dichotomously extended frontward.

The movable spring member 26 functions as a hinge that connects the yoke 24 and the armature 25 by elasticity, and biases the armature 25 in a direction away from the top end face 21*a* of the iron core 21 (upward) by the spring action of the hinge spring 26*c*. The movable contact 30 made from a predetermined contact material is mounted to the tip of each spring arm 26*d* by, for example, swaging. Accordingly, the number of the movable contacts 30 is two in total. The spring arms 26*d* of the movable spring member 26 are inserted into the space SP between the upper wall 20*e* and the upper flange 20*a* of the spool 20 from the rear side, and the movable contacts 30 are arranged in the space SP.

The right and left ends of the vertical portion 26*a* of the movable spring member 26 form a pair of right and left terminals 31*b* (a first terminal) that is bent frontward at approximately a right angle and extended downward. The bent formed terminals 31*b* are arranged along right and left corner portions at the rear end of the recess portion 12 of the base block 1, and penetrate through the bottom portion 11 of the base block 1 in the top-to-bottom direction.

A fixed terminal member 32 (a second member) is a conductive plate member formed by die-cutting and bending, for example, a copper sheet. As illustrated in FIG. 1, the fixed terminal member 32 integrally includes a front plate portion 32*a* extended in front of the spool 20 in the vertical direction, a horizontal portion 32*b* (a second horizontal portion) formed by bending the top portion of the front plate portion 32*a* rearward at approximately a right angle, branched from the top portion of the front plate portion 32*a* in the right-to-left direction, and dichotomously extended, and a pair of right and left terminals 32*c* (a second terminal) formed by bending the right and left end portions of the front plate portion 32*a* rearward at approximately a right angle and extended lower than the front plate portion 32*a*.

Each horizontal portion 32*b* is inserted into the space SP from the front side of the spool 20, and is positioned below the spring arm 26*d* of the movable spring member 26 in the assembled state of the electromagnetic relay as illustrated in FIG. 3. The fixed contact 34 opposed to the corresponding movable contact 30 is mounted to the top face of each horizontal portion 32*b* by, for example, swaging. Accordingly, the number of the fixed contacts 34 is two in total. As illustrated in FIG. 3, the bent formed terminals 32*c* are arranged along right and left corner portions at the front end of the recess portion 12 of the base block 1, and penetrate through the bottom portion 11 of the base block 1 in the top-to-bottom direction.

The backstop 33 (a stopper) is a conductive plate member formed by die-cutting and bending, for example, a copper sheet. The backstop 33 integrally includes a horizontal portion 33*a* extended in the right-to-left direction, and a side plate portion 33*b* that is bent downward from the right end portion of the horizontal portion 33*a* at approximately a right angle. The backstop 33 prevents the abrasion of or the damage to the movable contacts 30, and positions the movable contacts 30. The backstop 33 is detachably mounted to the slits 20*f* of the spool 20. For example, instead of the backstop 33, another fixed terminal member including a fixed contact may be inserted into the slits 20*f*. In this case, the movable contact 30 is arranged between the fixed contact of the another fixed terminal member and the fixed contact 34, and the contact portion 3 forms a so-called transfer contact.

The horizontal portion 33*a* is inserted into the slits 20*f* from the front side, and is positioned above the spring arms 26*d* of the movable spring member 26 in the assembled state illustrated in FIG. 3. At this time, as illustrated in FIG. 3, the side plate portion 33*b* is arranged to the right of the right side wall 20*d* of the spool 20, and the side plate portion 33*b* is on the same plane as the right side surface of the upper flange 20*a*. The right and left surfaces of the terminals 31*b* and 32*c* are on the same planes as the right and left side surfaces of the upper flange 20*a*, respectively. Thus, the components of the electromagnetic relay 50 are compactly arranged in a limited space.

As illustrated in FIG. 1, two elastic members 35 each opposed to the corresponding movable contact 30 are mounted on the bottom surface of the horizontal portion 33*a* of the backstop 33. The elastic member 35 prevents the abrasion of or the damage to the movable contact 30, and positions the movable contact 30.

In the assembled state of the electromagnetic relay 50, as illustrated in FIG. 3, the terminals 32*c*, the coil terminals 23, and the terminals 31*b* are aligned in the front-to-rear direction and protrude downward from the base block 1. The heights of the bottoms of the terminals 32*c*, 23, 31*b* are approximately the same as each other. Any of the terminals 32*c*, 23, 31*b* or all the terminals 32*c*, 23, 31*b* may be integrally formed with the base block 1 by insert molding. The terminals 32*c*, 23, 31*b* are dispersed in the front-to-rear and right-to-left directions of the electromagnetic relay 50. This configuration reduces the size of the electromagnetic relay 50 and sufficiently provides the distance between the terminals, thereby easing the formation of a pattern of a circuit on which the electromagnetic relay 50 is mounted.

As illustrated in FIG. 1, on right and left side walls 41 of the cover 4, formed is box-shaped accommodating portions 42 for accommodating the permanent magnets 51. The top side of the accommodating portion 42 is opened, and the permanent magnet 51 is inserted into the accommodating portion 42 from the opening at the top side. The permanent magnet 51 is fixed in the accommodating portion 42 by a rib (not illustrated) in the accommodating portion 42, or fixed in the accommodating portion 42 by an adhesive. To configure the direction of the magnetic field in the gap between the fixed contact and the movable contact to be a direction from right to left, the right permanent magnet 51 is arranged so that the surface at the contact side is the N-pole while the left permanent magnet 51 is arranged so that the surface at the contact side is the S-pole (see FIG. 5). As illustrated in FIG. 5, the right and left permanent magnets 51 are arranged at positions at which the right and left permanent magnets 51 sandwich the movable contacts 30 and the fixed contacts 34. This arrangement of the permanent magnets 51 enables to extinguish and interrupt an arc even when an arc is generated in any of the movable contacts 30 and the fixed contacts 34 of two sets.

As illustrated in FIG. 6, the right and left permanent magnets 51 are arranged at positions at which the right and left permanent magnets 51 sandwich the movable contacts 30 and the fixed contacts 34 and are not opposed to the electromagnet 2 (i.e., the coil 22 and the iron core 21) in the right-to-left direction. Since the right and left accommodating portions 42 hold the permanent magnets 51, the right and left accommodating portions 42 are also arranged at positions at which the right and left accommodating portions 42 sandwich the movable contacts 30 and the fixed contacts 34 and are not opposed to the electromagnet 2 in the right-to-left direction. In FIG. 6 and FIG. 7, the position of the permanent magnet 51 is indicated by hatching. The reason why the right and left permanent magnets 51 are arranged at positions at which the right and left permanent magnets 51 sandwich the movable contacts 30 and the fixed contacts 34 is to extend an arc generated between the movable contact 30 and the fixed contact 34 frontward by electromagnetic force to extinguish the arc. The reason why the right and left permanent magnets 51 are arranged at positions at which the right and left permanent magnets 51 are not opposed to the electromagnet 2 is to prevent the magnetic field generated by the permanent magnets 51 from affecting the effect of the magnetic field by the electromagnet 2.

In FIG. 6, while the permanent magnet 51 is extended from the upper wall 20*e* of the spool 20 to the top of the terminal 32*c*, the permanent magnet 51 may be extended from the upper wall 20*e* of the spool 20 to the bottom end of the front plate portion 32*a* as illustrated in FIG. 7. In the case of FIG. 7, the front plate portion 32*a* of the fixed terminal member 32 functions as an arc runner for extending and extinguishing an arc. Since the arc is attracted to a material having a strong magnetic attraction (a magnet), an arc generated between the movable contact 30 and the fixed contact 34 is extended to the bottom end of the front plate portion 32*a*, and the arc is cooled and easily extinguished.

As illustrated in FIG. 5, the front plate portion 32*a* has a large area, and is configured to cover most of the front face of the electromagnetic relay 50. The large area of the front plate portion 32*a* allows the area in which an arc is extended to be larger. On the other hand, an extra space for the front plate portion 32*a* does not have to be provided in the electromagnetic relay 50. Thus, the electromagnetic relay 50 does not increase in size.

Furthermore, this configuration allows an arc to be extended to the terminal 32*c* that is bent at approximately a right angle from the front plate portion 32*a*, thereby easily cooling and extinguishing the arc. As described above, the part of the terminal 32*c* of the fixed terminal member 32 also functions as an arc runner for extending and extinguishing an arc.

In the electromagnetic relay 50 of the present embodiment, as illustrated in FIG. 6 and FIG. 7, when the terminal 32*c* is connected to the positive (+) side and the terminal 31*b* is connected to the negative (−) side, the electric current flows through the terminal 32*c*, the fixed contact 34, the movable contact 30, and the terminal 31*b* in this order. On the other hand, the direction of the magnetic field of the permanent magnet 51 is a vertically downward direction with respect to the plane of paper of FIG. 6 and FIG. 7. When an arc is generated when the movable contact 30 separates from the fixed contact 34, the arc is subjected to Lorentz force based on Fleming's left-hand rule, and is extended frontward (to the left side in FIG. 6 and FIG. 7). At this time, the arc is extended frontward and advances downward along the front plate portion 32*a*, or advances downward and rearward along the front plate portion 32*a* and a part of the terminal 32*c*. As described above, the present embodiment can extend an arc along the front plate portion 32*a* and the terminal 32*c*, and thus easily extinguishes the arc.

In the electromagnetic relay 50 illustrated in FIG. 4 through FIG. 7, the backstop 33 is detached from the slits 20*f* of the spool 20. When the electromagnetic relay 50 is used at low voltage, the backstop 33 can be attached to the electromagnetic relay 50. On the other hand, especially when high voltage is applied to the electromagnetic relay 50, the small gap between the movable contact 30 and the fixed contact 34 may affect the interruption of the arc. Thus, when high voltage is supposed to be applied, the backstop 33 is detached from the electromagnetic relay 50 to secure the gap between the movable contact 30 and the fixed contact 34, thereby improving the arc-interrupting performance. As described above, the electromagnetic relay of the present embodiment can be used for low voltage application and high voltage application by basically the same configuration.

The operation of the electromagnetic relay 50 of the present embodiment will next be described. When operating voltage is not applied to the coil 22 of the electromagnet 2, the movable spring member 26 biases the armature 25 in a direction away from the top end face 21*a* of the iron core 21 by spring action of the movable spring member 26. Accordingly, the movable contact 30 is held at a non-operating position (a recovery position) a predetermined distance away from the fixed contact 34. When the backstop 33 is attached to the electromagnetic relay 50, the movable contact 30 contacts with the elastic member 35 of the backstop 33.

On the other hand, when operating voltage is applied to the coil 22 of the electromagnet 2, magnetic attractive force of the electromagnet 2 attracts the armature 25 to the top end face 21*a* of the iron core 21 against the spring force of the movable spring member 26, and the movable contacts 30 move downward. Accordingly, the movable contact 30 contacts with the fixed contact 34, and the movable contact 30 is stationarily held at the operating position.

Since the contact pairs each including the movable contact 30 and the fixed contact 34 are located at the right and left, a parallel circuit is formed between two contact pairs when the electromagnet 2 operates. Accordingly, the electric current is branched off and flows through each of two sets of the contact pairs.

As described above, when the electric current is branched off, the electric current flowing through the movable contact 30 and the fixed contact 34 of each set decreases. Thus, the amount of heat generated in each movable contact 30 and each fixed contact 34 is reduced. Furthermore, since the decrease in the amount of heat generation reduces the contact resistance between the movable contact 30 and the fixed contact 34 of each set, the heat generation between the contacts is reduced. This results in a drastic reduction in the overall amount of heat generated in the movable contacts 30 and the fixed contacts 34.

The heat generated in the movable contact 30 and the fixed contact 34 is respectively transferred to the movable spring member 26 and the fixed terminal member 32, and then released to the outside of the electromagnetic relay 50 through the terminals 31*b* and 32*c*. In this case, since the terminals 31*b* are located at the right and left (two in total), and the terminals 32*c* are located at the right and left (two in total), the heat generated in the movable contacts 30 is favorably released from the two terminals 31*b*, and the heat generated in the fixed contacts 34 is favorably released from the two terminals 32*c*. Therefore, the heat is efficiently released. Especially the movable contacts 30 and the fixed contacts 34 are separated into right and left. This configuration promotes the heat transfer to the two terminals 31*b* and 32*c*, and enables to release the heat from the whole of the electromagnetic relay 50 uniformly.

In addition, both contact pairs form a parallel circuit. Accordingly, the electric current flows through the both contact pairs in the same direction as illustrated in FIG. 5. On the other hand, as described previously, the magnetic field by the right and left permanent magnets is oriented in the direction from right to left. Accordingly, whether an arc is generated in the right contact pair or in the left contact pair, the generated arc can be extended in the same direction (in the anterior direction).

As described above, the present embodiment provides the movable contacts 30 and the fixed contacts 34 at the right and left, and provides the terminals 31*b* and 32*c* at the right and left. This configuration enables the efficient heat release to the outside, and reduces the amount of heat generated in the contact portion 3. Therefore, the electromagnetic relay 50 of the present embodiment is easily applied to a circuit in which large inrush current flows through the electromagnetic relay 50, such as a control circuit of an on-vehicle electric power steering. Moreover, since the amount of heat generation is reduced, the electromagnetic relay 50 has a compact structure capable of being mounted on a printed board.

In the above-described embodiment, the horizontal portion 32*b* and the front plate portion 32*a* of the fixed terminal member 32 is branched in the right-to-left direction and dichotomously extended, but two fixed terminal members that are branched into right and left, and each of which includes the fixed contact 34 and the terminal 32*c* may be provided. In this case, the fixed contact 34 and the terminal

32*c* on one of the fixed terminal members 32 are completely electrically separated from the fixed contact 34 and the terminal 32*c* on the other of the fixed terminal members 32. Thus, the contact failure of the fixed contact 34 can be checked with respect to each fixed terminal member 32, and it can be easily determined which of the right and left fixed contacts 34 is abnormal.

In the above-described embodiment, the terminals 31*b*, 23, 32*c* are formed straight in the vertical direction, but the tip of each terminal 31*b*, 23, 32*c* may be bent in the right-to-left direction. This configuration allows the electromagnetic relay 50 to be easily mounted on a substrate.

Moreover, two terminals 31*b* and two terminals 32*c* are provided, but the number of the terminals 31*b* may be greater than or less than the number of the corresponding contacts 30, and the number of the terminals 32*c* may be greater than or less than the number of the corresponding contacts 34.

As described above, in the present embodiment, the right and left permanent magnets 51 and the right and left accommodating portions 42 are arranged at positions at which the right and left permanent magnets 51 and the right and left accommodating portions 42 sandwich a pair of the movable contacts 30 and a pair of the fixed contacts 34 and are not opposed to the electromagnet 2 in the right-to-left direction. Accordingly, the arc-interrupting performance is improved. Even when the movable contact and the fixed contact of a first set malfunction, especially the electromagnetic relay 50 can operate with the movable contact and the fixed contact of a second set. Thus, compared to an electromagnetic relay including one set of a movable contact and a fixed contact, the continuous current-carrying performance is improved. Moreover, unlike a plunger-type electromagnetic relay, the electromagnetic relay 50 of the present embodiment needs no plunger. In addition, the electromagnetic relay 50 of the present embodiment needs no card that operates a movable-side spring terminal. Therefore, the electromagnetic relay 50 of the present embodiment is small in size and light in weight.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

an electromagnet;

a first member configured to integrally include:

a single first horizontal portion to which an armature to be attracted to the electromagnet is fixed;

a single vertical portion to which a yoke connected to the electromagnet and the armature is fixed;

a hinge spring connected between the single vertical portion and the single first horizontal portion;

a pair of spring arms that are extended frontward from the single first horizontal portion;

a pair of movable contacts, each of the pair of movable contacts being fixed to a corresponding spring arm of the pair of spring arms; and a pair of first terminals that is extended downward from the single vertical portion;

a second member configured to integrally include:

a single front plate portion that is extended in front of the electromagnet in a vertical direction;

a pair of second horizontal portions that are formed by bending a top portion of the single front plate portion rearward, is extended from a top portion of the single front plate portion;

a pair of fixed contacts, each of the pair of fixed contacts being fixed to a corresponding second horizontal portion of the pair of second horizontal portions and opposed to the pair of movable contacts; and a pair of second terminals extended downward from the single front plate portion;

a pair of separate permanent magnets without being attached to a magnetic material configured to be arranged at positions at which the pair of separate permanent magnets sandwiches the pair of movable contacts and the pair of fixed contacts and is not opposed to the electromagnet in a direction of a line which passes through a center of mass of each of the permanent magnets; and a cover configured to include an accommodating portion that accommodates the pair of permanent magnets and to cover the electromagnet, the first member, and the second member, wherein, when the electromagnet is energized, and the movable contacts are spaced from the fixed contacts, a magnetic field extends from one of the separate permanent magnets, across gaps between the pairs of movable and fixed contacts and to the other of the separate permanent magnets, and both of a pair of arcs formed between the pair of movable contacts and the pair of fixed contacts are extinguished by being moved by the magnetic field away from between the movable and fixed contacts and to the single front plate portion, wherein current between the pair of fixed contacts and the pair of second terminals flows through the single front plate portion, wherein a direction of a current between one of the pair of movable contacts and one of the pair of fixed contacts is the same as a direction of a current between another of the pair of movable contacts and another of the pair of fixed contacts, and the single front plate portion is configured to be an arc runner for extending and extinguishing both of the pair of arcs.

2. The electromagnetic relay according to claim 1, wherein the electromagnet includes a spool to which a coil is mounted, a pair of side walls that sandwiches the pair of movable contacts and the pair of fixed contacts is raised on the spool, and the pair of side walls includes a slit that detachably supports a stopper capable of being contacted by the pair of movable contacts.

3. The electromagnetic relay according to claim 1, wherein the pair of separate permanent magnets is extended from the positions at which the pair of separate permanent magnets sandwiches the pair of movable contacts and the pair of fixed contacts to a bottom end of the single front plate portion.

4. An electromagnetic relay comprising:

an electromagnet;

a first member configured to integrally include:

a single first horizontal portion to which an armature to be attracted to the electromagnet is fixed;

a single vertical portion to which a yoke connected to the electromagnet and the armature is fixed;

a hinge spring connected between the single vertical portion and the single first horizontal portion;

a pair of spring arms that are extended frontward from the single first horizontal portion;

a pair of movable contacts, each of the pair of movable contacts being fixed to a corresponding spring arm of the pair of spring arms; and a pair of first terminals that is extended downward from the single vertical portion;

a second member configured to integrally include:

a single front plate portion that is extended in front of the electromagnet in a vertical direction;

a pair of second horizontal portions that are formed by bending a top portion of the single front plate portion rearward, is extended from a top portion of the single front plate portion;

a pair of fixed contacts, each of the pair of fixed contacts being fixed to a corresponding second horizontal portion of the pair of second horizontal portions and opposed to the pair of movable contacts; and a pair of second terminals extended downward from the single front plate portion;

a pair of separate permanent magnets without being attached to a magnetic material configured to be arranged at positions at which the pair of separate permanent magnets sandwiches the pair of movable contacts and the pair of fixed contacts and is not opposed to the electromagnet in a direction of a line which passes through a center of mass of each of the permanent magnets, wherein, when the electromagnet is energized, and the movable contacts are spaced from the fixed contacts, a magnetic field extends from one of the separate permanent magnets, across gaps between the pairs of movable and fixed contacts and to the other of the separate permanent magnets, and both of a pair of arcs formed between the pair of movable contacts and the pair of fixed contacts are extinguished by being moved by the magnetic field away from between the movable and fixed contacts and to the single front plate portion, wherein current between the pair of fixed contacts and the pair of second terminals flows through the single front plate portion, wherein a direction of a current between one of the pair of movable contacts and one of the pair of fixed contacts is the same as a direction of a current between another of the pair of movable contacts and another of the pair of fixed contacts, the single front plate portion is configured to be an arc runner for extending and extinguishing both of the pair of arcs, and the single front plate portion is configured to be an arc runner for extending and extinguishing both of the pair of arcs.

5. The electromagnetic relay according to claim 1, wherein the electromagnet includes a spool to which a coil is mounted, a pair of side walls that sandwiches the pair of movable contacts and the pair of fixed contacts is raised on the spool, and the pair of side walls includes a slit that detachably supports a stopper capable of being contacted by the pair of movable contacts.

6. The electromagnetic relay according to claim 1, wherein the pair of separate permanent magnets is extended from the positions at which the pair of separate permanent magnets sandwiches the pair of movable contacts and the pair of fixed contacts to a bottom end of the single front plate portion.

7. The electromagnetic relay according to claim 1, wherein the magnetic material is a yoke.

* * * * *